US011457718B2

(12) United States Patent
Garrison

(10) Patent No.: US 11,457,718 B2
(45) Date of Patent: Oct. 4, 2022

(54) ROTATING COSMETIC APPLICATOR SYSTEM

(71) Applicant: ELC Management LLC, Melville, NY (US)

(72) Inventor: Chad Garrison, San Pedro, CA (US)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 17/515,468

(22) Filed: Oct. 30, 2021

(65) Prior Publication Data

US 2022/0133016 A1 May 5, 2022

Related U.S. Application Data

(60) Provisional application No. 63/108,634, filed on Nov. 2, 2020.

(51) Int. Cl.
*A45D 34/04* (2006.01)
*A45D 40/26* (2006.01)

(52) U.S. Cl.
CPC ..... *A45D 34/046* (2013.01); *A45D 34/043* (2013.01); *A45D 34/045* (2013.01); *A45D 40/264* (2013.01); *A45D 40/265* (2013.01); *A45D 40/267* (2013.01); *A45D 2200/10* (2013.01)

(58) Field of Classification Search
CPC .... A45D 200/10; A45D 34/04; A45D 34/042; A45D 34/043; A45D 34/045; A45D 34/046; A45D 34/047; A45D 34/048; A45D 40/26; A45D 40/262; A45D 40/264; A45D 40/265; A45D 40/267; A45D 40/268
USPC ..... 401/122–130
See application file for complete search history.

(56) References Cited

U.S. PATENT DOCUMENTS 2,631,826 A * 3/1953 Wolf ..... B43L 25/00 74/89.45
3,115,664 A * 12/1963 Del Ponte ..... A45D 34/048 366/318
4,056,111 A 11/1977 Mantelet
4,397,326 A 8/1983 Formica
4,632,136 A 12/1986 Kingsford
(Continued)

FOREIGN PATENT DOCUMENTS

JP 2005-095531 A 4/2005
KR 20120010580 A 2/2012

OTHER PUBLICATIONS

PCT International Search Report; International Application No. PCT/US2021/057480; Completion Date: Feb. 24, 2022; dated Feb. 24, 2022; 20.27.

(Continued)

*Primary Examiner* — David J Walczak
(74) *Attorney, Agent, or Firm* — Peter Giancana

(57) ABSTRACT

A rotating cosmetic applicator system features a unique rod/wiper relationship that causes the rod to rotate when it passes through the wiper. The applicator head rotates in one direction when the user inserts the applicator through the wiper, and in the opposite direction when the user removes the applicator through the wiper. The result is a more even loading of product onto the applicator head than with a conventional mascara system. A more even load of product on the brush will support a more consistent experience for the user.

6 Claims, 4 Drawing Sheets

(56) References Cited

U.S. PATENT DOCUMENTS

| | | | | |
|---|---|---|---|---|
| 5,192,153 | A * | 3/1993 | Gueret | A45D 40/265<br>401/129 |
| 6,565,276 | B1 | 5/2003 | Diaz | |
| 2015/0055997 | A1 | 2/2015 | Holloway | |
| 2017/0311698 | A1 | 11/2017 | Miller | |

OTHER PUBLICATIONS

PCT Written Opinion of the International Searching Authority; International Application No. PCT/US2021/057480; Completion Date: Feb. 24, 2022; dated Feb. 24, 2022; 20.27.

* cited by examiner

ROTATING COSMETIC APPLICATOR SYSTEM

FIELD OF THE INVENTION

The invention is in the field of cosmetic applicators, specifically applicators that rotate as they are inserted into and removed from a product reservoir.

BACKGROUND

Cosmetic brushes that rotate during application are known. Rotation occurs around the longitudinal axis of the applicator rod. U.S. Pat. No. 4,056,111 describes a motor-driven, rotatable mascara brush. The motor may comprise a rewindable spiral spring (i.e. a clock-work motor) or a battery powered motor may be used. U.S. Pat. No. 6,565,276 discloses a battery powered motor, rotating mascara brush head. In either case, the brush can be made to rotate in either direction to accommodate left and right handed operation for either eye. The stated advantage is convenience and less movement required by the user. U.S. Pat. No. 4,397,326 describes a non-motorized mascara brush, the head of which is free to rotate and does so when the brush head contacts the eyelashes during application, but not when the applicator is being inserted into and removed from a product reservoir. It is the act of brushing that causes the rotation. It is claimed that the rotation of the brush head allows more mascara to be deposited on the lashes in a single application than otherwise would be possible. U.S. Pat. No. 4,632,136 describes a rotating brush applicator for mascaras having a viscosity range from 1,500 to 25,000 poise at ambient temperatures. A motor housed in the handle of the applicator turns the brush, however, It is explicitly disclosed that the brush is not made to rotate until after the brush is removed from the reservoir. No shearing of the product takes place in the reservoir, because the purpose of the rotating brush is not to shear the product, it is to separate and comb the lashes. JP 2005-095531 discloses an electric motor that operates a gear that rotates a brush head at fixed speed. The rotation occurs around the long axis of the applicator rod. None of these references disclose a mascara brush of simple design, that rotates only when being inserted into and removed from a product reservoir.

While the present invention has been described in terms of an applicator and wiper for mascara, the invention is not so limited. The structure and principles described herein are applicable to various relatively viscous products, such as creams and gels.

Mascara applicators must perform two broad functions, which we call loading and grooming. Loading means that the applicator takes up a dose of product for depositing onto the eyelashes. The act of grooming the eyelashes includes depositing the product, and smoothing it evenly over the lashes, and separating and/or curling the individual lashes. A single applicator must perform both functions. However, mascara is a heavy, viscous, sticky product that does not flow easily in manufacture, filling or application.

SUMMARY OF THE INVENTION

The rotating cosmetic applicator system of present invention comprises a cosmetic applicator (10) and custom wiper (11). The applicator (10) comprises a handle (1), a stem (2) fixedly attached to the handle; a rod (3) which proximal end is rotatably attached to the stem, and an applicator head (4) fixedly attached to the distal end of the rod. The rod is formed as helix, and has a square cross section. The rod and applicator head are enabled to rotate when being inserted into and removed from a product reservoir, but not at other times. The wiper comprises a square orifice. The rotation of the applicator head results in a more even loading of product onto the applicator head than with a conventional mascara system. A more even load of product on the brush will support a more uniform and consistent application experience for the user.

DETAILED DESCRIPTION

Figure 1:
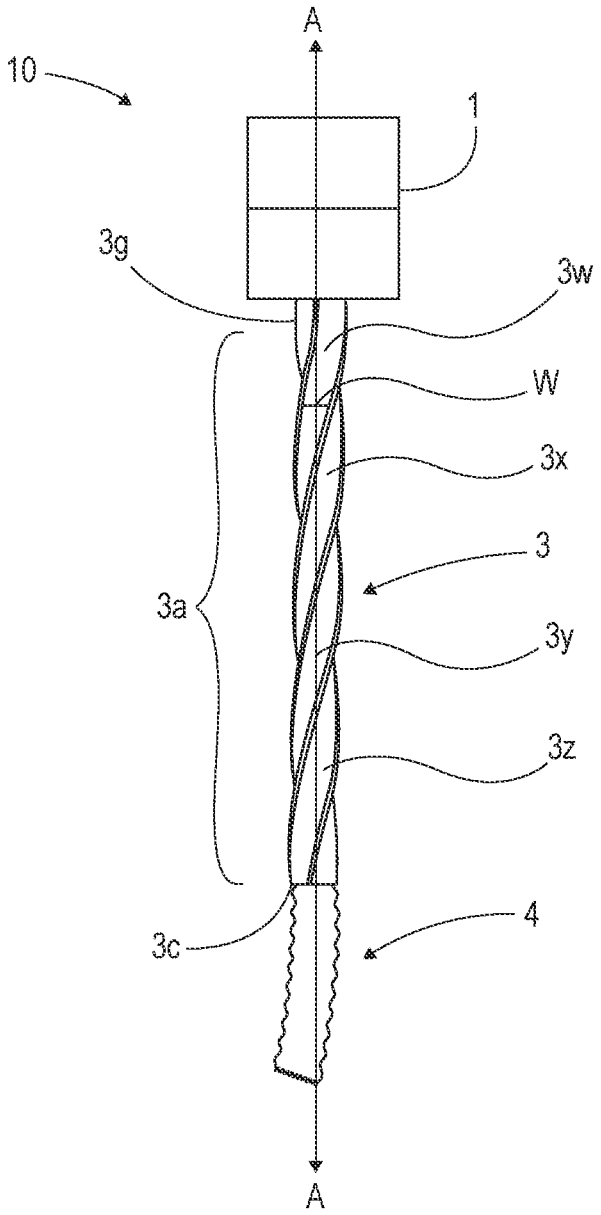
FIG. 1 depicts one embodiment of a cosmetic applicator according to the present invention.

The rotating cosmetic applicator system of present invention comprises a cosmetic applicator (10) and custom wiper (11). Referring to FIG. 1, a cosmetic applicator (10) according to the present invention comprises a handle (1), a stem (2), an helical rod (3), and an applicator head (4). The applicator is intended to be used with the custom wiper (11), as described herein. For directional reference, a longitudinal axis, A, extends through the center of the applicator from the handle to the applicator head.

The Handle

Figure 2:
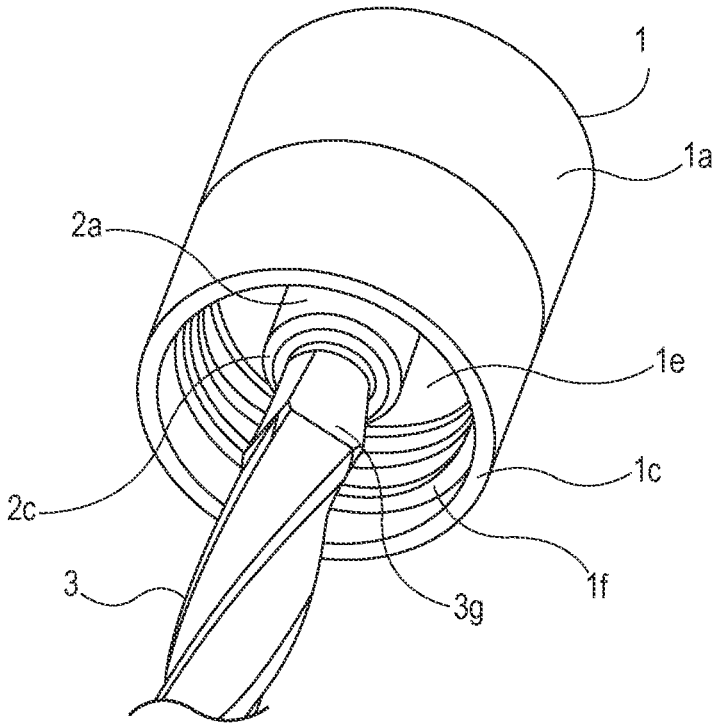
FIG. 2 shows the connection of the helical rod to the stem.
Figure 3:
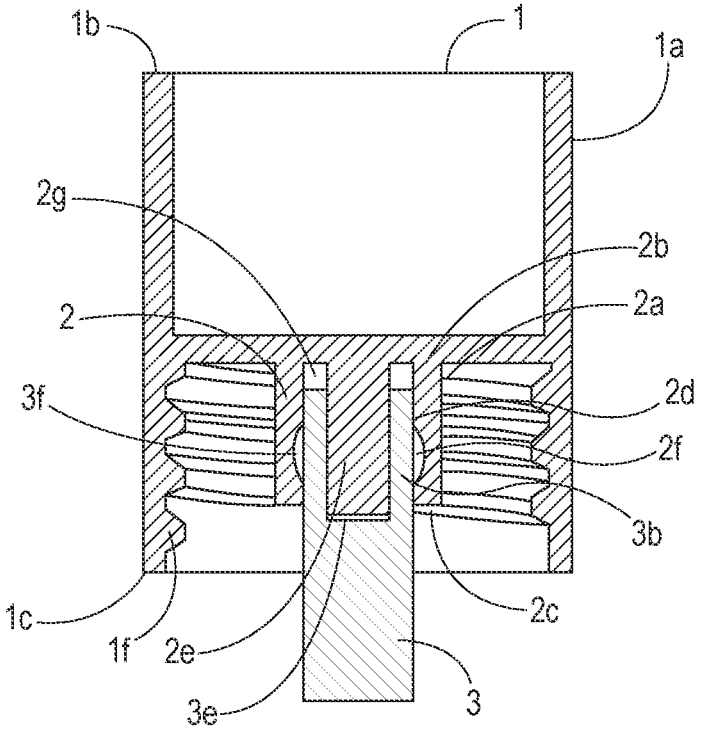
FIG. 3 is a cross section that shows the connection of the helical rod to the stem.
Figure 4:
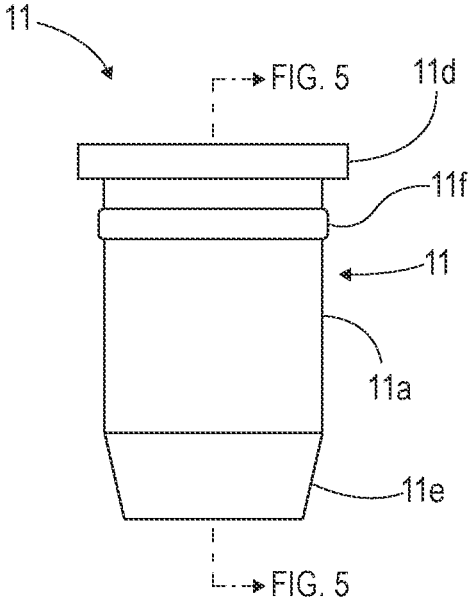
FIGS. 4-6 depict a wiper with a square orifice.
Figure 5:
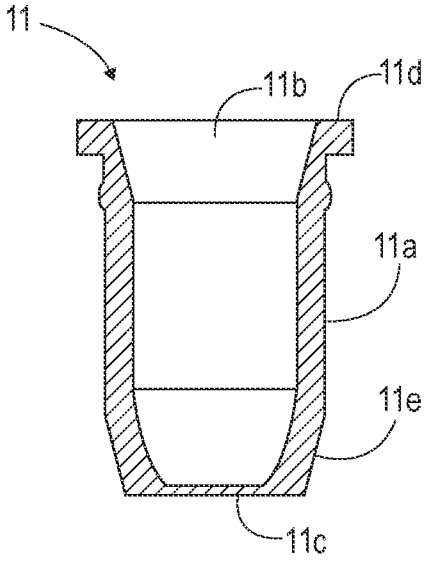
Figure 6:
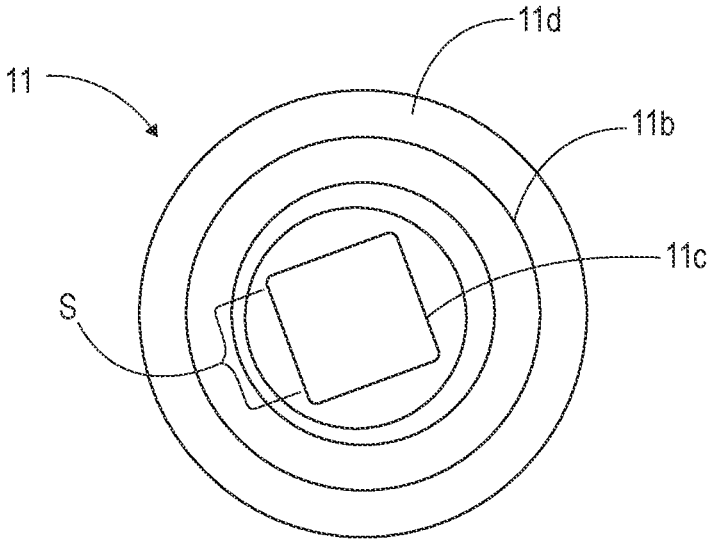
Figure 7:
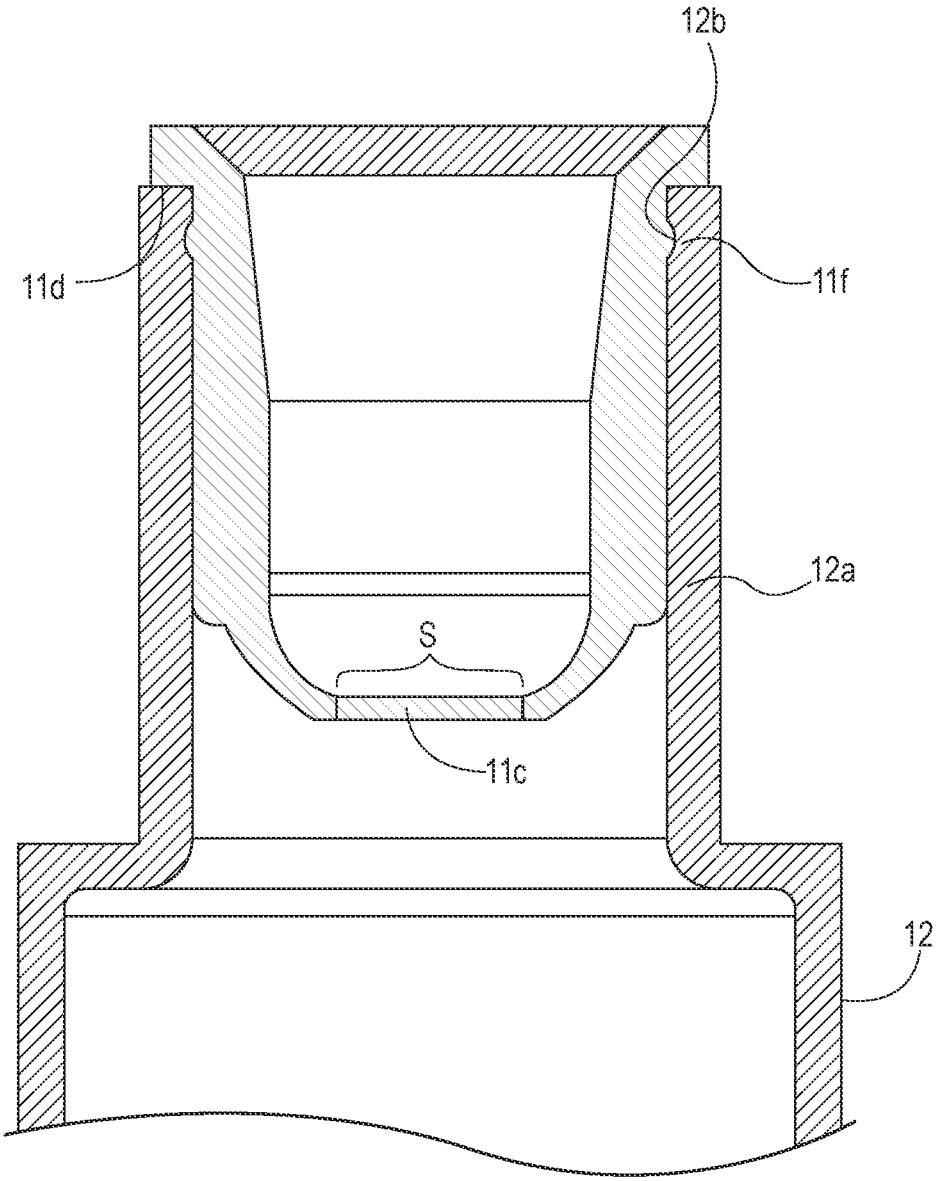
FIG. 7 depicts the wiper situated in a cosmetic container.

Referring to FIGS. 1-3, the handle (1) comprises one or more lateral walls (1*a*) that define an interior space, a proximal end (1*b*), a distal end (1*c*), an interior surface, and a transverse wall (1*e*) that extends across the interior space. In this context, transverse means perpendicular to the longitudinal axis, A. The handle allows a user to grasp and manipulate the applicator. As is common, the handle also serves as a closure for a container of cosmetic product. For this reason, the handle may have screw threads (1*f*) on the interior surface for mating to a threaded container (12).

The Stem

The stem (2) is a short extension that depends longitudinally from the transverse wall (1*e*) of the handle (1). The stem comprises a wall (2*a*), the proximal end (2*b*) of which is fixedly connected to transverse wall so that there can be no relative movement between the handle and stem. The stem extends longitudinally for a distance to its distal end (2*c*). The height of the wall is such that when the applicator is mounted to a container (12), the distal end of the wall will not extend into the lower (square) orifice (11*c*) of the wiper (11, see below). The stem comprises a hollow space (2*g*) of circular cross section, bounded by an interior surface (2*d*), the interior surface having a characteristic diameter. The distal end (2*c*) of the stem wall is opened to receive the helical rod (3). The attachment of the stem to the helical rod must allow the helical rod to rotate relative to the stem. Various means for achieving this may be possible. For example, the stem may be provided with an annular groove (2*f*) on its interior surface (2*d*). Optionally, the stem may also comprise a stabilizing pin (2*e*). The stabilizing pin may extend further then the wall (2*a*) of the stem. Its purpose is described below.

The Helical Rod

The helical rod (3) comprises a cylindrical proximal portion (3*b*) and a distal end (3*c*). In between the proximal portion and the distal end, is a helical section (3*a*) wherein the rod is twisted into a helical shape of square cross section. The helical rod is connected to the stem, such that the rod is free to rotate relative to the stem, while any longitudinal movement relative to the stem is prevented.

The cylindrical proximal portion (3*b*) is connected to and depends from the stem (2). Specifically, the proximal portion of the helical rod (3) passes through the opened distal end (2*c*) of the stem, and is located in the hollow space (2*g*). If the stem has been provided with an annular groove (2*f*), as described above, then cylindrical proximal portion (3*b*) of the helical rod is provided with a raised annular ring (3*f*), the diameter of which is larger than that of the hollow space, but smaller than that of the annular groove in which it sits (see FIG. 3). During assembly, the raised annular ring is forced into the hollow space of the stem until it comes to rest in the annular groove (2*f*). Thereafter, the helical rod will not detach from the stem during normal use of the applicator (10). Of course, the stem could be provided with a raised annular ring, while the annular groove is located on the cylindrical proximal portion of the helical rod. Also, the articulation of the rod and stem may be achieved by other means, the essential feature being that the helical rod is free to rotate relative to the stem, while any longitudinal movement is prevented. However, in use, the relatively long rod, extending from the shorter stem (2), may experience a certain amount of wobbliness. Therefore, the stem may be provided with a stabilizing pin (2*e*), as described above. If so, then the cylindrical proximal portion (3*b*) of the helical rod is provided with a slot (3*e*) for receiving the stabilizing pin. In general, the longer the stabilizing pin, the more stable will be the helical rod. Therefore, the stabilizing pin and slot may extend further than the wall (2*a*) of the stem. The stem, helical rod and stabilizing pin are concentric. Ideally, the diameter of the cylindrical portion (3*b*) of the helical rod is only slightly less than the diameter of the hollow space (2*g*) of the stem. Likewise, the diameter of the stabilizing pin (2*e*) is only slightly less than the diameter of the slot of the helical rod. By "slightly less" in this context, I mean no more than 1 mm, preferably no more than 0.8 mm, more preferably no more than 0.4 mm. This will allow the helical rod to rotate with respect to the stem, while giving the most lateral stability to the rod.

The cylindrical proximal portion (3*b*) of the helical rod (3) transitions into the helical section (3*a*) of square cross section. This transition (3*g*) takes place outside of the stem (2). The properties of helices are well known. A helix is a three-dimensional curve that has a central longitudinal axis. At any point on the helix, the angle between the tangent line and the axis is constant. The pitch of a helix is the height of one complete helix turn, measured parallel to the axis of the helix. The helical section comprises a number of turns over its length. For example, the number of turns may be from 0.5 to 5 turns; preferably 0.5 to 3 turns, more preferably 1 to 2 turns over the length of the helical section. The pitch of the helix will be determined by the length and number of turns of the helical section. Preferably, the pitch is constant over the length of the helical section. Preferably, the helical rod is molded plastic.

This helical section (3*a*) of the helical rod (3) comprises four twisting faces (3*w*, 3*x*, 3*y*, 3*z*) that account for the square cross section of the helical rod. These faces have a shortest width, W, that is measured approximately perpendicular to the longitudinal axis, A. Preferably, the faces are flat or very nearly flat when moving along the perpendicular to the longitudinal axis, A. That is, the faces do not bow inward or outward.

The Applicator Head

Referring to FIG. 1, an applicator head (4) is fixedly attached to the distal end of the helical rod (3). There is no relative motion between the rod and applicator head, which means that the applicator head will rotate with the helical rod. The most common mascara applicator head is a bristle brush, although other types may be useful. A typical mascara brush head comprises a core and bristles that extend from the core. The applicator head may be implemented as a plastic molded or non-molded component.

A non-molded applicator head typically comprises a twisted wire core that supports a multitude of fiber bristles in a predetermined arrangement. Typically, the wire core may be fashioned from stainless steel having a diameter from 0.5 to 1 mm. The bristles may be nylon, hollow or solid, and typically from 0.1 to 0.5 mm. The number of fiber bristles may vary, but will typically be between 250 and 500. The proximal portion of the wire core has no bristles and is used for attaching to the distal end of the helical rod (3). For example, the proximal portion of the wire core may be inserted into a channel that extends longitudinally inside the helical rod, and retained there by friction and/or adhesive.

A plastic molded applicator head comprises a core and integrally molded bristles that extend from the core. A proximal portion of the molded core is fashioned for attaching to the distal end of the helical rod. For example, the proximal portion may be implemented as a cylindrical rod that is inserted into a channel that extends longitudinally inside the helical rod, and retained there by friction and/or adhesive. Alternatively, the proximal portion of the molded core may be fashioned as a sleeve that is fitted over the distal end of the helical rod, and retained there by friction and/or adhesive. In this case, it is preferable, but not required, if a distal portion of the helical rod transitions to a cylindrical shape to more easily slide into the sleeve of the molded applicator head. Exemplary materials that can be used in the present invention to create the molded applicator head include, but are not limited to: silicone elastomers, thermoplastic elastomers (such as, for example, styrene-ethylene-butylene-styrene block copolymer—SEBS), vinyl elastomers (EVA), thermoplastic polyester elastomers (Hytrel® from Dupont de Nemours), thermoplastic polyurethane elastomers (Pellethane® from Dow Plastic), Nitrile, and EPDM. Hardness of the chosen material preferably ranges from about 35 MPa (35 shore D Hytrel® from Dupont de Nemours) to about 1180 MPa (82 shore D Hytrel®). In general, harder, less flexible materials will be more suitable for the molded brush portion (14), which is intended to spread and declump a thick mascara product, and separate and lengthen the eyelashes.

The Wiper

A rotating applicator according to the present invention works with a custom wiper (11) that is intended to be located in the neck (12*a*) of a container (12) for a cosmetic product, such as mascara. The wiper performs all of the functions of a conventional wiper; for example, as the applicator is withdrawn from the container, the wiper cleans the rod, removes excess mascara from the brush, and smooths out the mascara on the brush prior to application to the eyelashes. However, In addition to these, a custom wiper of the present invention causes the applicator head to rotate whenever the helical rod (3) is being raised or lowered through the wiper.

A (11) wiper according to the present invention comprises a roughly cylindrical, hollow body (11*a*) that has an upper orifice (11*b*) at its proximal end, and a tapered section (11*e*) that terminates in a lower orifice (11*c*) at its distal end. A flange (11*d*) surrounds the upper orifice, such that when the wiper is fully seated in a container neck (12*a*), the flange rests on the top of the neck. As so far described, the wiper is similar to known wipers. However, in a wiper according to the present invention, the lower orifice is not round, but square. If each side of the square orifice has a length, S, then the present invention requires that the following condition be met:

$$S/\sqrt{2}<W<S$$

where W is the width of each face of the helical rod. When this condition is met, the four sides of the wiper orifice will exert a force on the four faces (3*w*, 3*x*, 3*y*, 3*z*) of the helical rod, as the helical rod is raised or lowered through the wiper orifice. The result is a twisting or rotating motion of the helical rod (3) with respect to the wiper. Since the applicator head (4) is rigidly attached to the helical rod, it also rotates. The applicator head rotates one way when the user inserts the applicator through the wiper, and the opposite way when the user removes the applicator through the wiper. The result is a more even loading of product onto the applicator head than with a conventional mascara system. A more even load of product on the brush will support a more uniform and consistent application experience for the user.

As it is raised and lowered, the helical rod (3) also exerts an opposite force on the wiper (11), however, the wiper is held stationary in the neck (12*a*) of the container (12) by friction between the wiper and container neck. Optionally, the wiper may be formed with a retention bead (11*f*). When the wiper is fully seated on the container, the bead fits into a complimentary groove (12*b*) located on an inner wall of the container neck. The bead and groove stabilize the wiper in the container neck by opposing any movement of the wiper, such as the twisting force that is transmitted to the wiper as the applicator is being inserted into and withdrawn from the container.

The container (12) need not be special in any way. The applicator and wiper described herein form a rotating cosmetic applicator system that may be used in any container that typically employs a wiper.

The area around the lower orifice (11*c*) of the wiper (11) will have to be sufficiently rigid to resist deforming under the pressure applied on it by the helical rod (3). This portion should possess the necessary degree of rigidity. In general, thermoplastic elastomers may not be suitable materials for the area around the lower orifice. Rather, LDPE and/or Hytrel® would be more suitable. The entire wiper may be fashioned of one material, or a combination may be used to provide a less rigid, more flexible upper portion for sealing in the container neck (12*a*), and more rigid lower portion for withstanding the forces exerted by the helical rod.

As noted above, it is preferable if the four faces (3*w*, 3*x*, 3*y*, 3*z*) of the helical section (3*a*) of the helical rod (3) are flat when moving perpendicular to the longitudinal axis, A. That is, the faces do not bow inward or outward. This is important since, each face of the helical rod is cleaned by one side of the square orifice (11*c*) of the wiper (11). A flat face will allow more effective cleaning, because the faces of the helical rod will be able to slide up against the sides of the wiper orifice.

Depending on the mascara product, it may be necessary to ensure that the articulation between the helical rod and wiper orifice does not become overly clogged with product, so that the excessive force is needed to raise and lower the applicator. This clogging may be avoided by reducing the W, the width of each face of the helical rod, but then the wiper might be less effective at cleaning the helical rod. Another solution is to maintain significant interference between each face of the helical rod and the wiper orifice (that is, W≈S), but round the corners of the helical rod (3) (i.e. where two faces meet) and/or the corners of the wiper orifice.

Once the applicator head (4) has been removed from the product reservoir through the wiper (11), the applicator head is evenly loaded with product all around. The user will apply the product in the usual way, and the applicator will not significantly rotate relative to the handle (1), because the force applied to the applicator by the eyelashes will not be enough to significantly rotate the applicator head.

While the foregoing invention has been described in terms of an applicator and wiper for mascara, the invention is not so limited. The structure and principles described herein are applicable to relatively viscous products, such as creams and gels.

What is claimed is:

1. A rotating cosmetic applicator system comprising:
- a handle;
- a stem that depends longitudinally from the handle,
- a helical rod comprising:
  - a helical section of square cross section and a distal end, wherein:
    - each face of the helical section has a width, W; and
    - the helical rod is connected to the stem, such that the rod is free to rotate relative to the stem, while any longitudinal movement relative to the stem is prevented;
- an applicator head that is attached to the distal end of the helical rod, such that there is no relative motion between the rod and applicator head; and
- a wiper comprising a hollow body that has a square lower orifice, wherein:
  - each side of the square orifice has a length, S, such that:

$$S/\sqrt{2}<W<S.$$

2. The rotating cosmetic applicator system of claim 1, wherein:
- the handle has one or more lateral walls, an interior surface, and a transverse wall that extends across the interior space;
- the stem depends longitudinally from the transverse wall of the handle, and comprises a hollow space bounded by an interior surface of circular cross section, the interior surface having an annular groove; and
- the helical rod further comprises a cylindrical proximal portion that is located in the hollow space of the stem, and that has a raised annular ring that sits in the annular groove of the stem.

3. The rotating cosmetic applicator system of claim 2, wherein:
- the stem comprises a stabilizing pin; and
- the cylindrical proximal portion of the helical rod is provided with a slot for receiving the stabilizing pin.

4. The rotating cosmetic applicator system of claim 2, wherein:
- the helical section comprises from 0.5 to 5 turns over its length; and
- the pitch of the helix is constant over the length of the helical section.

5. The rotating cosmetic applicator system of claim 2, wherein:
- the handle has screw threads on the interior surface; and
- the applicator head is a molded applicator head that comprises a core and integrally molded bristles that extend from the core.

6. The rotating cosmetic applicator system of claim 2, wherein:

the wiper comprises an upper portion and a lower portion, wherein the lower portion is more rigid than the upper portion.

* * * * *